US005189934A

United States Patent [19]

Davidson et al.

[11] Patent Number: 5,189,934

[45] Date of Patent: Mar. 2, 1993

[54] APPARATUS FOR CUTTING AND REMOVING PORTIONS FROM A MATERIAL WEB

[75] Inventors: Mats Ingvar Davidson; Dan Davidson, both of Ganghester, Sweden

[73] Assignee: Eton Construction AB, Sweden

[21] Appl. No.: 623,427

[22] PCT Filed: Dec. 27, 1988

[86] PCT No.: PCT/SE88/00701

§ 371 Date: Dec. 10, 1990

§ 102(e) Date: Dec. 10, 1990

[87] PCT Pub. No.: WO89/11806

PCT Pub. Date: Dec. 14, 1989

[30] Foreign Application Priority Data

Jun. 2, 1988 [SE] Sweden ..... 8802081
Jun. 2, 1988 [SE] Sweden ..... 8802082

[51] Int. Cl.[5] ..... B26D 1/08; B26D 7/18

[52] U.S. Cl. ..... 83/153; 83/151; 83/401; 83/101; 83/937; 83/939; 26/15 FB

[58] Field of Search ..... 83/76.1, 158, 160, 451, 83/939, 940, 941, 101, 153, 155.1, 401; 26/15 FB

[56] References Cited

U.S. PATENT DOCUMENTS

| | | | |
|---|---|---|---|
| 3,735,660 | 5/1973 | Pearl | 83/940 X |
| 4,069,729 | 1/1978 | Kuts | 83/939 X |
| 4,112,797 | 9/1978 | Pearl | 83/941 X |
| 4,137,804 | 2/1979 | Gerber et al. | 83/941 X |
| 4,277,890 | 7/1981 | Portnoff | 83/939 X |
| 4,730,526 | 3/1988 | Pearl et al. | 83/451 X |

*Primary Examiner*—Frank T. Yost
*Assistant Examiner*—Clark F. Dexter
*Attorney, Agent, or Firm*—Lerner, David, Littenberg, Krumholz & Mentlik

[57] ABSTRACT

Arrangement for production of sections cut out from a material web (18), such as sections for articles of clothing. It comprises a carrier element (19) with a deposit surface (17) for the material web (18), an automatic cutter (16) which is displaceable over the cutting member (70; 77) is supported by the slide arrangement. The cutting member is moved by means of a computer program along the intended contours of the sections which are to be cut out. The carrier element (19), which can be a conveyor belt, is of a material which is elastically compressible. The material, by virtue of its elasticity, tends to form a main plane in which, as a result of the compressibility of the material, depressions can be formed by exerting a force on the material, for example by pressing-down of bottom parts of the cutting and picking members.

13 Claims, 5 Drawing Sheets

APPARATUS FOR CUTTING AND REMOVING PORTIONS FROM A MATERIAL WEB

BACKGROUND OF THE INVENTION

The present invention relates to an arrangement for production of sections cut out from a material web, such as sections for articles of clothing.

In the manufacture of articles of clothing in the clothing industry, work is essentially carried out in a cycle involving the following steps:

1. Determining the configuration of the cloth sections for the garments which are to be produced; thus the pattern work, which results in a number of garment sections for different sizes of different designs.

2. Positioning the pattern sections on a cloth web, with account being taken of the following factors a. That each garment section receives the correct side of the cloth on the correct side of the garment section in relation to its position in the garment (many garment sections occur twice in the same configuration, but in right and left design).

b. That each garment section acquires the correct turning direction in relation to the structure of the cloth (such as its thread direction, in order for the desired lie to be achieved).

c. That, if the cloth is patterned and the garment sections are to have pattern matching, they are placed on the pattern of the cloth according to the pattern matching.

d. That, where requirements a and b are satisfied and, in the case of patterned cloths, also c, an as economic as possible positioning of the garment sections on the cloth web should be achieved; thus, they will be set out together in such a way that the intermediate spaces, which constitute the cloth wastage, have as small a surface area as possible. In this connection the best result can often be obtained by the sections of several garments being mixed with each other along the cloth web or even being mixed with garment sections of another size or of another garment design. A mixing, along a defined stretch of the cloth web, of garment sections from several garments thus very often gives a better yield than is achieved by placing all the garment sections of one garment along a defined stretch of the cloth web. However, no further improved effect is obtained, in terms of the wastage, if garment sections are mixed from more garments than a certain optimum number. In addition, a mixing along an excessively long stretch is difficult to monitor.

3. Cutting the garment sections out in the predetermined position.

4. Gathering together, into a set, all the garment sections which are to be sewn together.

5. Sewing together of the garment sections.

It is of course desired that the said operations and the necessary transport work associated therewith should be carried out as efficiently as possible by mechanical means.

Prior art:

As regards the preparatory stages, patent publication GB 2,129,282 discloses data programming of the configurations of the various garment sections in a cutting apparatus which operates with an automatic cutter. Thus, in this connection, the garment sections are cut out from a cloth web and can thereafter be gathered together into the sets.

How the garment sections are to be positioned on the cloth web is determined manually, but it is known to use computer support in this respect. This means that, by simulation on a display screen, it is possible to position the garment sections on the cloth web, after which the computer provides information on what degree of utilization of the cloth has been achieved, and thereafter a rearrangement can be carried out manually etc with successive adjustment to a suitable degree of utilization of the cloth.

The computer program then controls both the shape of the cutting contours and their position on the cloth web.

Thus, the garment sections are cut out after the shape of the garment sections has been determined and programmed in a computer device, and also, thereafter, their position in relation to each other on the cloth web.

The cutting-out itself can be carried out as in the installations for mechanical implementation known from U.S. Pat. Nos. 1,136,048 and 3,572,202, by means of several layers of cloth being laid one upon the other, after which a cutting member is passed through all the layers In this way a number of identical sections are obtained, and such an installation is thus designed for series production of a number of identical garments. The cloth web is laid out , as is also known, on a cutting table by means of a carriage with a cloth roll moving across the cutting table while the cloth web is fed out By means of several movements of the carriage over the cutting table, several cloth layers can be laid out one upon the other.

As regards the cutting member itself, it is known, for example from previously cited U.S. Pat. No. 3,572,202, to use a knitting knife which moves up and down through the cloth layers. However, such a knife is subject to considerable wear and at the same time it requires very great sharpness in order to cut through the cloth in an acceptable manner. Other means have also been tried, such as lasers or water jets, but these have not as yet provided any advantageous result in the cutting of woven and knitted cloths. In the case of cutting equipment of this type, it is known to make use of the said computer programming of the cutting member.

It is also known from U.S. Pat. Nos. 4,385,956 and 4,462,292 to carry out automated cutting from a single layer of material. In this connection, cutting-out by means of reel knives has been described.

Previously cited GB 2,129,282 has also described the automation of the gathering of the cut-out sections for joining together in groups suitable for handling in the continued sewing operation. This, therefore, is the known technique in the field of the invention.

Furthermore, the sewing cycle itself has also to a large extent been automated, including the transport for distribution to various work stations All this, therefore, belongs to the known technique.

A corresponding technique can be used and has to a certain extent also been used outside the area of production of articles of clothing from cloth. Thus, for clothing articles, other materials are also used, such as non-woven cloth and foils, where welding often replaces sewing. It also happens that objects other than articles of clothing are produced in a similar manner and of similar material, namely bags, protective coverings, filter bags etc. A similar work cycle can also be used in even more divergent fields, namely in the production of objects of material from hard sheets, such as plates. The cut-out pieces are joined together, after having been brought together, in one or a number of consecutive work stations. The said applications, and others which lie outside the field of sewing, can also be included in the field to which the invention relates.

Technical problem:

Automation of the cycle described at the outset for production of articles of clothing and other products from the material web from which pieces incorporated in the product are cut results in an extremely complicated system. The automation can be carried out to a greater or lesser extent, and a number of variants can be chosen for the stages involved in the cycle. In the case of a total or extensive automation, there is extremely complicated equipment. The previously disclosed proposals and solutions, of which some have been mentioned above, constitute partial solutions within the cycle and are each aimed at specific solution variants.

There is, however, a great need to find other, improved solutions for achieving a higher degree of automation, simpler and operationally more reliable equipment, and overall high operational reliability in this area where a number of different materials are to be handled and different finished products are to be produced, these factors creating a risk of operational problems.

SUMMARY AND OBJECTS OF THE INVENTION

The present invention relates to an apparatus for cutting portions from a longitudinally extending web wherein the web is maintained in a substantially flat position during cutting operations, the apparatus comprises a longitudinally extending support surface for supporting the web in a pre-determined plane while it is being cut, the support surface includes a resiliently compressible composition upon which depressions are formed when a force is applied to the surface, cutting means moveably positioned above the support surface in operative association with the support surface for selectively cutting the web at pre-determined locations, and means for moving the support surface in a longitudinally extending direction.

The object of the invention is therefore to provide arrangements for carrying out various working moments in an installation for the automated production described.

A particular aim in this connection is to provide a deposit table for the material which is to be cut into pieces and thereafter gathered up for onward transport.

Other objects are to find efficient cutting members and picking members.

Solution:

According to the invention, the deposit table for the material which is to be cut into pieces and thereafter gathered up for onward transport is made of a material which is elastically compressible and whose one surface forms the said deposit surface By virtue of the compressibility of the material, depressions can be formed in the latter by exerting a force against the material.

This affords the possibility of designing the members for cutting-out with a bottom part which can be pressed down into the material of the deposit surface and be located under the material which is to be cut, and at the same time results in the latter being maintained essentially flat.

Similarly, the said solution means that the member for picking up the cut-out pieces can be designed as a nipping member with a bottom part which can be pressed down into the material of the deposit surface.

Furthermore, solutions incorporated in the arrangement for various parts of the same emerge from the following description and patent claims.

Advantages:

The solution according to this invention provides a high operational reliability and, by means of the said deposit table, the possibility of using cutting and picking equipment of an advantageous type which could not have been used previously in this context. The solution also includes this advantageous equipment.

DESCRIPTION OF THE DRAWING

The arrangement is described here on the basis of a number of exemplary embodiments and with reference to the attached drawings

DETAILED DESCRIPTION

Figure 1:
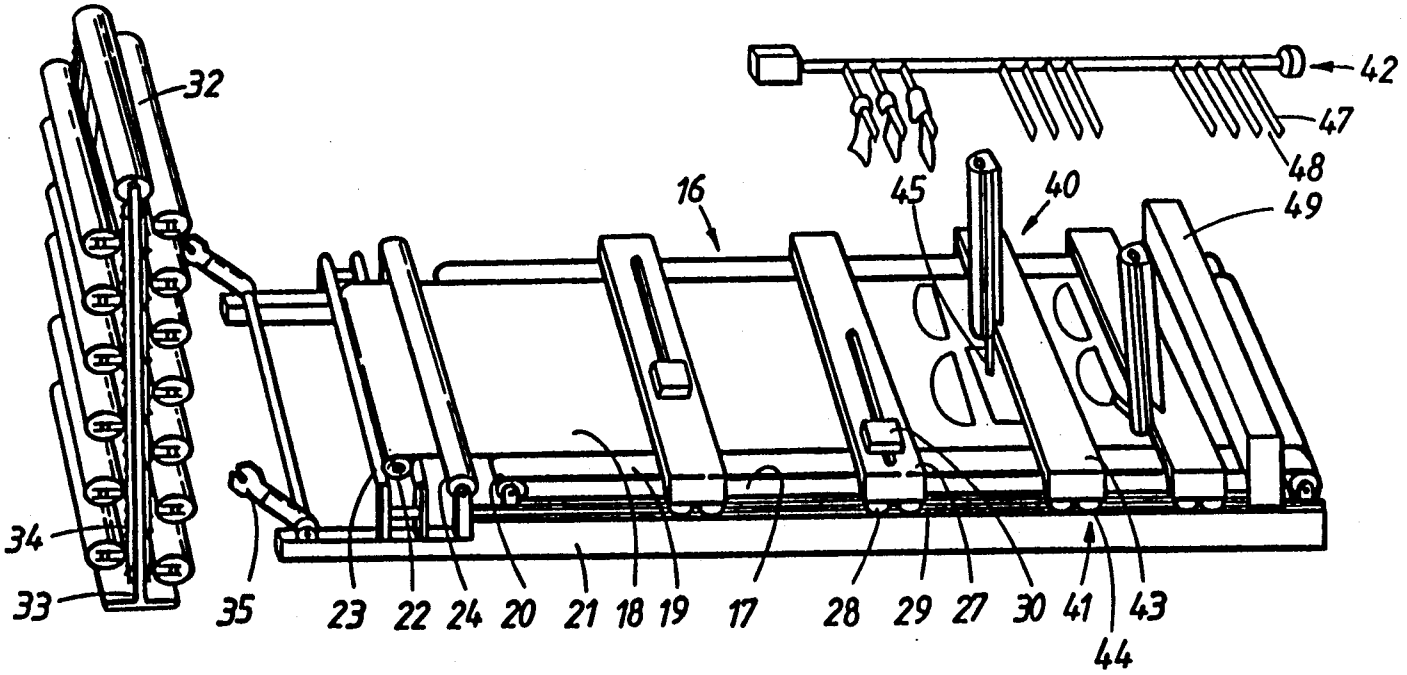
FIG. 1 shows a perspective view of an installation in which the arrangement according to the invention is included

The arrangement shown in FIG. 1 is suitable for incorporation in an installation for production of articles of clothing of textile material, but this does not rule out the possibility of the invention also being used for other types of production, such as production of garments by means of welding together or gluing, or production of other products, such as have been mentioned hereinabove.

The arrangement is designed for production of garment sections or parts of another conceivable product. This requires cutting of these sections and onward transport of sets gathered together The cutting is carried out in an automatic cutter 16, which is also shown in the figure. This automatic cutter operates over a working surface 17, for the material 18, preferably a cloth web, which is to be cut. The working surface 17 is made up of a conveyor belt 19 which runs over rollers 20, which are supported by a stand 21. The material web 18 can come, for example, from a material roll 22, which is supported by support surface 23. Arrangements in the form of, for example, double-threaded cylinders 24 can h=arranged for feeding and stretching the material web out over the working surface 17. For stretching a material web, for example of cloth, in connection with processing on a working surface, various arrangements are known which can also be used in this context. An arrangement may be mentioned here which has clamps, by means of which the material is stretched by virtue of the clamps being fixed on chains moving along the material web, so that the clamps can follow the material web during feeding of the latter.

The automatic device 16 itself comprises a carriage 27 which extends across the working surface 17 and runs by means of wheels 28 on a rail 29 on either side of the stand 21. The carriage 27 supports a slide arrangement 30 set transverse to the direction of movement of the carriage, which slide arrangement in turn supports a cutting member. For the cutting member the cutting arrangement is preferably provided with a mechanically operating knife.

Both the carriage 27 and the slide arrangement 30 are driven by means of motors, which are controlled from a computer device. The contours of each garment section can be programmed in the computer and output in the form of control data for the said motors. In this way the slide 30 can, during simultaneous movement of the carriage 27, reproduce the contours of the garment sections on the material web 18, so that the cutting member cuts out the garment sections. The latter have in this respect been given a defined position on the material web. This position is adapted so as to provide as high a yield as possible from the material web, i.e. as little wastage as possible. This positioning of the garment sections is also programmed in the computer. The figure shows how the automatic cutter can h=provided with two carriages. These can then be designed to cut a defined part of the material web. For example, as indicated, the first carriage is used for cutting the rear half of the material web, and the second carriage for cutting its front half. After the automatic cutters have effected cutting of their respective work areas, the material web is fed forwards by means of the feeding of the conveyor belt 19.

The carriages 27 thus generate the movement of the cutting members. This is carried out by control from a computer, as has been mentioned. The programming is set up in such a way that the greatest accelerations affect the slide 30, while the movement of the carriage along the rail takes place at lower accelerations. This makes it possible for the mass forces and, thus, the drive and brake forces on the heavier carriage to be kept low by means of lower acceleration, while the lighter slide can be subjected to greater accelerations without excessively great mass forces arising.

How this is essentially achieved will emerge from the following example: if it is assumed that the carriage must move to and fro, which is necessary if a circumscriptive cutting line is to be made, the lowest accelerations are obtained if the speed changes according to a sine curve. However, if it is not desired to cut a sine curve, the accelerations of the carriage are nevertheless allowed to follow such a sine curve or at least almost a sine curve. The compensations, which are required in order to obtain the desired curve, are effected by adapting the total movement to the desired curve by adaptation of the movement of the transverse slide. In practice, compromises must be utilized between accelerations of the carriage following a sine curve and the remaining adaptation of the cutting line effected by the transverse slide. The principle will however be clear, namely that the accelerations of the carriage and transverse slide are adapted to their respective masses in such a way as to obtain a suitable distribution of the mass forces on these two parts and the drive members designed for overcoming these forces for the parts.

The garment sections which are cut out by means of the automatic cutter from the material web 18 will, after the latter has been transported forwards from the working areas of the carriages 27 by means of the movement of the conveyor belt 19, be picked out and divided into sets.

The arrangement comprises an automatic picker 40 which is designed to transfer the garment sections cut out of the material web 18 from the working surface 17. The automatic picker comprises, on the one hand, picking arrangements 41 and, on the other hand, storage modules 42. The picking arrangements (two units are shown here) each consist of a carriage 43 which, like the carriages 27, runs on wheels 44 on the rail 29. The carriages 43 support picking members 45 which, like slides, can be moved along each carriage 43 and are designed, on the one hand, to be able to pick up each garment section from the working surface 17 and, on the other hand, to convey this up to one of the storage modules 42. Because the picking members can move over the working surface, on the one hand, in the longitudinal direction of the material web by means of the movement of the carriages and, on the other hand, in the transverse direction by means of the movement of the picking members with the aid of the transverse slides of the carriages, the picking members can, within a certain working area, pick a garment section regardless of where it has been cut out. By means of the movement of the conveyor belt 19, the material web can be moved with the cut-out areas in question to the working area of each picking member.

The picking members are also controlled by the said computer. In this respect they are controlled to detect the sections where they have been cut out from the material web, so that the picking members can be controlled so as to grip around the edge of the section in question. The shape of the sections is also programmed, as is the position in which they are hung for onward transport to the work stations, and which is determined depending on how the working cycle is carried out. How the base for the material web moves must also control the movement of the picking members, so that they can always find the respective garment sections even if the conveyor belt 19 has moved the material web after cutting.

The picking members are movable in the vertical direction for moving the garment sections to one of the storage modules 42, and they can also be swivelled. The picking members are preferably also designed in such a way that they can turn the garment sections in different directions with, for example, the upward-turned surface of the material web continuously in the upward-turned position after picking, or downward-turned, and also changes in different directions for the garment section with respect to the plane of the material web.

These said movements of the picking members are also controlled by means of the computer on the basis of an additional program adapted in accordance with the anticipated processing of the sections in the work cycle upon sewing together, as a complement to the program used for the positions and contours of the sections.

In the example shown the storage modules each consist of a number of holders, here shown as a number of consecutive plates 47, with mutual intermediate spaces 48. The intermediate spaces 48 are designed such that the picking members 45, in their upper position, can penetrate into the intermediate spaces and bring each garment section up into a position a short distance above the plates 47.

Each of the modules is intended to take up sections of a garment. Since different types of garments comprise different numbers and types of sections, the modules can be designed in different sizes with different numbers of plates and, thus, different capacities as regards the number of garment sections In the sewing of articles of clothing, it is often preferable for the person carrying out the sewing to have the sections delivered in a selective manner in such a way that, for example, all the sections belonging to the garment body are separate from those belonging to the garment arms, and these in turn from the collar sections.

The storage modules shown constitute only one example of how the storage rack for the automatic picker can be designed. If the storage modules are not adapted to directly transfer material to work stations in a processing installation, then, for this transport, further transport means are arranged with product carriers which take up the material from the storage modules in a manner not shown. During this take-up of the material, these product carriers are also controlled by means of the computer programming set up in the installation. It is also possible to bring the product carriers right up to the working area of the automatic picker for direct transfer to these. However, with an intermediate storage, it is possible to free the work cycle of the installation shown in FIG. 1 from the transport cycle in the processing installation, which operates according to other conditions than those of the installation described here.

After the cut-out sections have been removed from the conveyor belt 19, a wastage is left over, preferably in the form of narrow strips As mentioned, the cutting members can be programmed to divide up this wastage into smaller pieces. This wastage will expediently be removed before the conveyor belt swings round to its lower part. For this purpose an arrangement is designed, which is designated 49 in FIG. 1 and whose outside essentially has the shape of an elongate box, which, downstream of the working area of the automatic pickers, extends across the conveyor belt and is connected to an arrangement for taking up the material wastage.

The installation has now been described with regard to its aim and its main features There now follows a more detailed description of certain members.

FIG. 1 shows an arrangement for feeding rolls of material onto the conveyor belt of the installation. A large number of material rolls 32 are set up in a frame 33 supported by conveyor chains 34. A pivotable telescopic fork 35 can be arranged to change the rolls from the use position of the roll 22 shown in the figure to the storage position, which is shown for the rolls 32. In this way the provision of material to the automatic cutter can also be automated and programmed into the computer.

Figure 2:
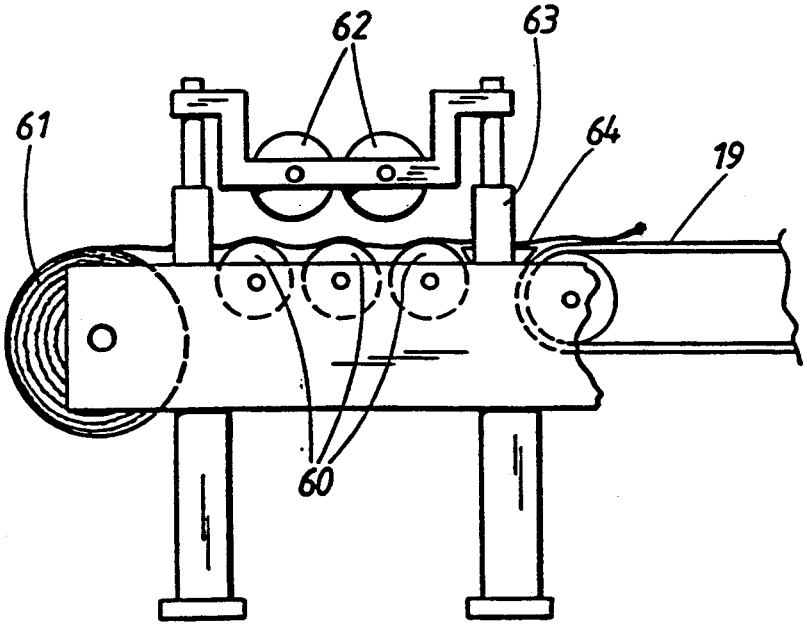
FIG. 2 shows an arrangement for feeding cloth into the installation. A cutting member is shown in side view in FIG. 3 and in top view in FIG. 4. A cutting member according to a second embodiment is shown in side view in a first position in FIG. 5 and in a second position in FIG. 6.

FIG. 2 shows an alternative arrangement for feeding the material web. In this respect it essentially replaces the cylinders 23 and 24 according to FIG. 1. This arrangement thus comprises, in front of one end of the conveyor belt 19 (see FIG. 2), three cylinders 5 whose upper surfaces are situated on the same level as, the upper part of the conveyor belt 19. A cloth roll 1 can be positioned in front of these three cylinders. Above the cylinders there are two further cylinders 2, which can be raised and lowered by means of power cylinders 3. A plane 4 connects the last cylinder 5 to the surface of the conveyor belt 19. The cylinders 5, like the cloth roll 1, are designed to be driven as the cloth web is fed in on the conveyor belt 19. In order to drive the cloth roll, an installation roller can be arranged, which is not however shown.

The conveyor belt 19 has a rough, gripping surface, as mentioned earlier. In addition to good feeding conditions for the cloth, this also provides the possibility of getting it to lie still during the machining, in particular cutting. During the cutting of the cloth the conveyor belt will also show the characteristic that its surface is slightly flexible in such a way that a lower leg of the cutting member can be moved down under the main surface by pressing down the material of the conveyor belt, without the cloth having to be raised to any appreciable extent. In a preferred embodiment, the conveyor belt 19 comprises a foam material which is elastically compressible, and is preferably an elastomer. Conveyor belt 19 also comprises a thin, substantially incompressible upper surface 19*a* which is preferably made of a material having a rough texture. A somewhat similar situation applies to the picking-up of the cut-out sections A further characteristic of the conveyor belt is that it is expediently designed so as to be air permeable. For example, it can be designed for the most part of a relatively thick layer of a foam material with open pores. Such a foam material allows the squeezing together, as mentioned, and at the same time it is possible to draw air through the material. The outer side, which forms the work surface 17, should then be lined with a textile material having the said grip characteristics.

The air permeability is used to hold the cloth, by means of air being drawn through the conveyor belt and pressing the cloth downwards. This is effected by means of vacuum chambers, in other words chambers which are connected to extraction pumps, which are placed under the working area of the automatic cutter. In a suitable embodiment such a suction box can be placed on the cutter carriage 27 and hang down under the conveyor belt, so that the box is situated on the underside of its top part. In this way the vacuum box only requires to have a size which corresponds to the movement area of the slide 30.

Alternatively, the pressing-down can be achieved by exerting an excess pressure on the topside of the material web by means of an air cushion. Mechanical members can also be used for the desired fixing against the cutting forces. For example, roller elements can follow the cutting member.

Figure 3:
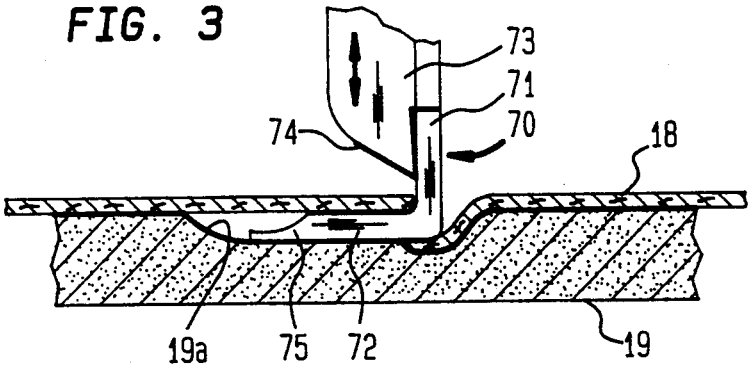
Figure 5:
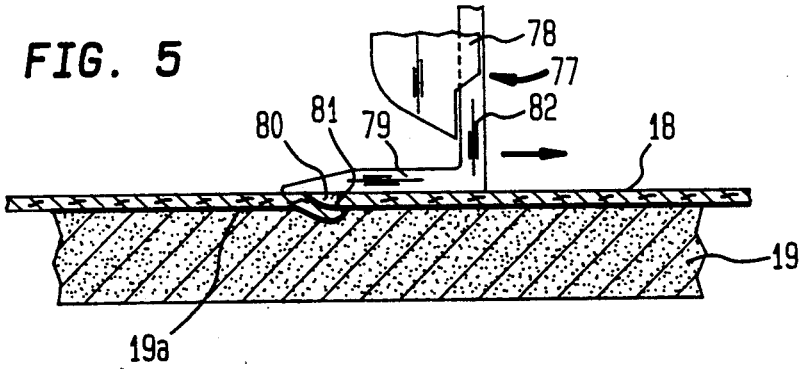
Figure 6:
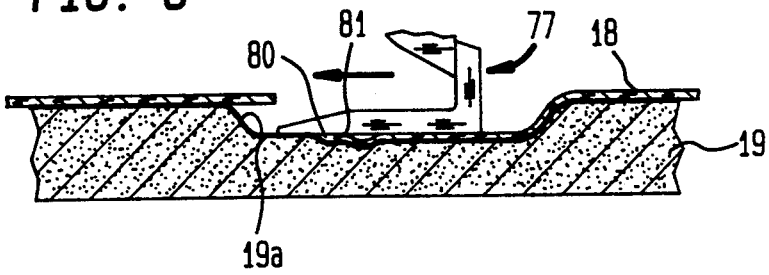

FIG. 3 shows a cutting member. This cutting member, like an alternative embodiment of the same in FIGS. 5 and 6, is designed to clip the cloth by means of cooperation between two cutters. Such a clipping thus means that a scissor part must be brought down under the cloth where it lies on the cutting surface, and at the same time a top knife works against this bottom knife and produces a clipping by means of the two cutters working against each other. This means that room must be created for the bottom cutter under the surface of the cloth. This is solved by means of the soft, flexible conveyor belt described It must be possible for the cutter to be brought down under the cloth not only from its edge, but also through earlier cuts which are situated on the outer surface of the cloth. This must be effected without the risk of wrinkling of the cloth or lifting of the latter and without the risk of the position being altered in such a way that the cut-out contours no longer match the pattern.

The fact that it must be possible for the bottom cutter also to be brought into cuts in the center of the cloth is based on the fact that the movement of the cloth during cutting takes place relatively slowly in relation to movements of the knife If one were to work forwards through the cloth during cutting from a previously made cut in order to reach the positions for new cuts, this would increase the operation times.

Figure 4:
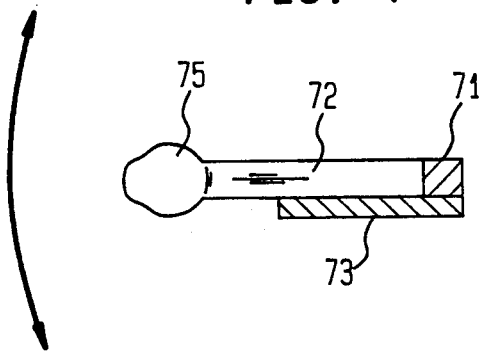

According to FIGS. 3 and 4 the cutting arrangement in accordance with the first embodiment consists of a bottom cutter 70 of L-shape with a vertical leg 71 and a horizontal leg 72. A top cutter 73 with a downward-turned edge 74 can run along the vertical leg. The upper edge of the horizontal leg 72 is designed as the second edge. The top cutter 73 is designed to execute an upward and downward movement by means of a drive arrangement (not shown), to such an extent that its edge 74 slightly overlaps the horizontal leg 72.

The horizontal leg 72 is finished with a flattened section 75. As will be described later, this is intended to be brought in under the cloth, after which clipping takes place by means of the forward and backward movement of the edge 74. For controlling this forward and backward movement members are arranged which can give the top cutter 73 different movement positions, short clips or long clips. In addition, it may be in an upper free position, as is shown in FIG. 3 The cutting member can be raised and lowered and can also be turned in different directions in its respective slide 30 The said computer programming is thus such that the turning direction of the bottom cutter is adapted to the direction of movement during cutting and while seeking the cutting position.

In the second embodiment there are essentially the same parts, that is a bottom L-shaped cutter 77 and a top, forward-moving cutter 78 The horizontal leg 79 of the bottom cutter bears a tooth 80 which has a transverse side 81 directed towards the vertical leg 82 of the bottom cutter. By means of its design, the tooth 80 has a unidirectional action upon movement, since its transverse edge 81 attempts to cling to a cloth edge while the lengthwise section glides over it. However, this effect can be obtained by means other than one tooth, for example by means of a whole series of teeth which are smaller than but to a large extent identical to the tooth 81.

Figure 7:
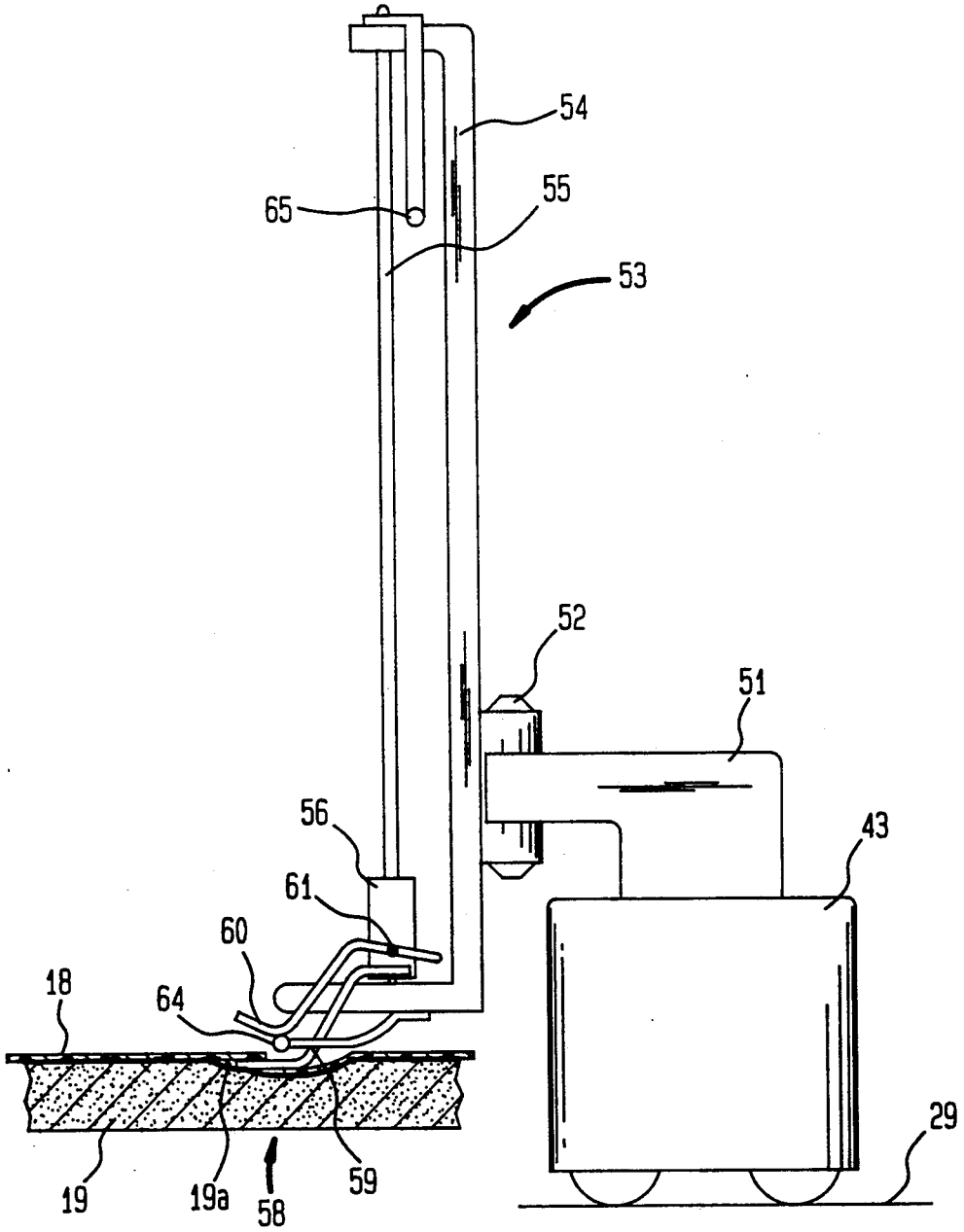
FIG. 7 shows a side view of a picking member.

The picking members 45 will now be described in greater detail with reference to FIG. 7. As has been previously stated, they are supported by the carriages 43 and can be moved over the working surface 17 in different directions. They can thus be moved forwards to each cutout garment section and moved in over this from different directions, and with a different direction of their picking members. Such a picking member is shown in FIG. 7 in side view (from the short side of the carriage 43). In this figure the carriage 43 is shown with its wheels which are intended to run on the rail 29. The picking members can in this way be moved in the longitudinal direction of the conveyor belt 19 with the aid of the carriage which is programmed to move for gathering up the cut-out pieces. For movement in the transverse direction of the web, the carriage supports a slide 51 which, by means of drive members not shown, can be moved in the longitudinal direction of the carriage 43 again in accordance with the said program.

The slide in turn supports, pivotably by means of a bearing 52 with vertical axle, the picking member itself which is designated 53 in FIG. 7. The picking member 53 has a pillar form with a stand 54 which supports a guide arm 55 for a runner 56. The runner 56 supports a nipping member 58 with a lower jaw 59 and an upper jaw 60. The jaws are thin and beak-like and are intended to grip around the pieces which are to be picked out. For this purpose the upper jaw 60 is pivotably mounted about an axle 61. The axle 61 is in turn, arranged on the runner 56 as clearly shown in FIG. 7. Within the area of movement of the jaw 60 there is a lower stop member 64 and an upper stop member 65. These are fixed on the stand 54. The lower stop member 64 is arranged to strike against that part of the jaw outside the axle 61, while the upper stop member 65 is positioned so as to strike against an inner part of the jaw before the axle 61. This means that, when the runner 56 is moved down the stand 54 and the jaw 60 strikes against the stop member 64, it is opened. In the same way, it is opened by striking against the stop member 65 at its topmost position.

As mentioned, the entire support is rotatable about the bearing 52 and can also be raised and lowered slightly.

The drive members for the various movements of the picking member are not shown However, they can consist of electric motors, hydraulic or pneumatic equipment. Such drive members are arranged, on the one hand, to move the carriage 43 along the rail and the slide 51 along the carriage, for turning the stand 54, for raising and lowering the latter, and for moving the runner with the nipping member 58 along the guide arm 55. The movements will be controlled by means of the said programming, such that the work pieces can be taken up from different directions by moving the nipping member 58 in over them, with the lower jaw 59 under the cut-out piece and with the upper jaw over the latter, and with the runner in the lower position, so that the jaws are open from each other. The programming is thus designed in such a way that it also takes into consideration the different positions of the nipping members 58 in relation to the carriage and the slide during turning thereof.

As regards the picking member, it is assumed that the conveyor belt 19 is soft and flexible, so that the lower jaw 59 of the picking member can be pressed down into the belt and form an indentation in the same.

Figure 8:
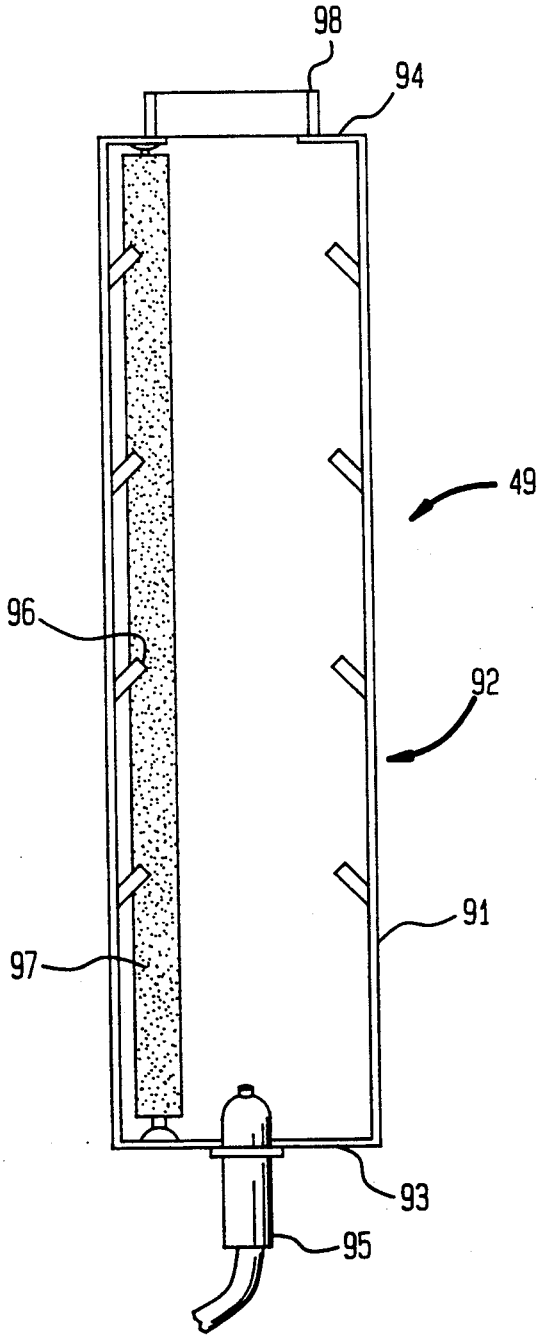
FIG. 8 shows a section through an arrangement for removal of material wastage.

The said arrangement 49 for removal of wastage is shown in greater detail in FIG. 8 in a horizontal section. The box has walls 91 and, in accordance with FIG. 1, a top. The walls 91 consist, on the one hand, of longitudinal walls 92 which extend across the conveyor belt, and a first gable 93 and a second gable 94. In the gable 93 a compressed air nozzle 95 is inserted, which is connected to an installation for production of compress-ed air. The gable wall 94 has a connection piece 98 which is connected to a container or line for take-up of the material wastage (not shown). In the longitudinal walls 92 openings 96 are formed which are directed towards the connection piece 98 and through which air can penetrate in from the surroundings. A brush cylinder 97 is rotatably mounted along the left longitudinal wall in FIG. 8. The box is open at the bottom, and this opening is situated close over the conveyor belt 19. The brush cylinder 97 lies so low that it rests against the conveyor belt in such a way that it can be rotated when the latter moves. The upper part of the conveyor belt, against which the brush cylinder 97 rests, moves from left to right in FIG. 8 (cf. FIG. 1).

The installation now described, in which the arrangement according to the invention is included, is therefore used in largely automated production of articles of clothing or other objects produced from pieces cut out from a material web. The following stages are included in the work cycle of the installation:

I. Identification of the positioning of the garment sections which are to be cut out from the cloth web. This identification is effected on the basis of data from the program which is designed for positioning of the garment sections on the cloth web and for cutting out by means of the cutting member. At the same time data is obtained which indicates which garment sections are to be brought together into one and the same set, and also their position in the set.

II. Cutting-out with the material web lying on the working surface.

III. Gathering together, by means of the automatic picker, those garment sections which are to be sewn together in one passage in the sewing installation. The automatic picker is thus controlled by the data for the identification, allocation and position of the garment sections, which data is taken from the cutting program. Thus, by means of the picking, sets of garment sections are formed IV. Programming of carriers according to the transport cycle through the sewing installation, which will apply to the different garment sections in each set. (It is stated here that the carriers are programmed, which means that the installation can be programmed to move the carriers in a certain path depending on identification of these).

V. Transfer of the gathered sets to a carrier programmed for each set.

Thereafter the transport and the sewing cycle take place.

The entire production cycle will now be described by way of a functional description of the installation described hereinabove and shown in the figures, which installation includes the preferred embodiment of the arrangement according to the invention.

If it is assumed that the roll feeding arrangement shown on the far left in FIG. 1 is used, then the roll 32, which is to be used, is fed forwards to the grip position of the forks 35 in accordance with the computer control in the selected program. By pivoting the forks, the roll can be transferred and laid upon the rollers 23 and, by means of a grip arrangement such as the cylinders 24 or the cylinder arrangement shown in FIG. 2, can be moved over to the working surface 17 on the conveyor belt 19. The cylinder arrangement according to FIG. 2, which can be combined with the roller magazine arrangement according to FIG. 1, operates in such a way that the cloth web is fed forwards from the roll 1 to bear against the first cylinder 5. By rotation of these cylinders, the cloth web is moved forwards, lying on their upper surfaces, and further on over plane 4 and onto the conveyor belt 19, whose upper part moves from left to right in FIG. 2 The cloth is thus carried by the cylinders and fed forwards in this manner, by which means the risk of them winding up on corresponding rotating cylinders is avoided. After a certain length has been fed, the cloth reaches the surface of the conveyor belt 19 which is assumed to be very rough, gripping powerfully against the cloth. This can be achieved with separate textile materials, which give a good grip against other textile material. When this feed onto the conveyor belt has taken place, the cloth requires resistance and should be stretched, and it may be necessary to control its feed. This is carried out by the cylinders 2 being lowered by means of power transmission 3, in such a way that the cloth is clamped in between the bottom and top cylinders. In this way there is a possibility of controlled feeding. By means of lateral movement of the top cylinders, the cloth can be guided so that it is laid straight on the conveyor belt 19 during its forward feed. The cylinders can also be designed with two threads which move outwards from the central area of the cylinders in this intended rotational direction, by which means the cloth is stretched crosswise. The cylinders are also designed so that, upon gripping against each other, they feed the cloth backwards from the conveyor belt 19, which will take place when the cloth is to be changed. In this case the cutting arrangement is designed to cut the cloth when all garment sections have been cut out, and a piece can then remain and extend in over the conveyor belt, which is then pulled back with simultaneous winding on the cloth roll 1. As has been mentioned, measures are taken to ensure that the material web 18 is kept stretched on the working surface. By means of feed movements of the various members, inter alia the conveyor belt 19, the cloth is fed forwards so that its end lies at the end of the working area at the left of the two carriages 27 belonging to the automatic cutter 16. By means of the cutting member of the slide 30, half the cloth web can now be divided up into garment sections by cutting-out of these. Thereafter, the cloth web is fed forwards by means of the conveyor belt 19 so that its end is located at the rear end of the cutting area of the right of the two carriages 27. The first carriage cuts up half the cloth web, and the second part is thus then cut up by means of the right carriage, while the left can at the same time continue with the next piece of the material web at its far side. During cutting, either the material web can be fed forwards stepwise or the cutting can be effected "smoothly", i.e. with continuous movement, in which connection this is programmed into the computer, so that it is compensated during movement of the carriages.

When cutting is to be carried out with the cutting member shown in FIGS. 3 and 4, it is pressed downwards in the flexible material of the conveyor belt. On top the cloth can thus lie stretched over this depression. So that the cloth is not affected by the lateral forces which can arise upon cutting, it is held pressed against the rough surface of the conveyor belt by means of the said vacuum. The top cutter 73 is now brought in downward and upward movements against the horizontal leg 72 of the bottom cutter 70, while the cutting member is at the same time moved forwards. A cut therefore arises in the direction of movement of the cutting member, which movement is controlled by displacement of the carriage 27 and the slide 30 in accordance with computer programming. As has been mentioned, the top cutter 73 has different movement areas. In the case of straight cuts, the cutter can have a large stroke and therefore cut a relatively long piece for each stroke, by reason of which the feeding rate can be relatively great. In the case of sharp bends or small radii, however, such a straight cut would not give an even, curved line The arrangement is programmed in this case to move the cutter 73 in short movements and slightly downwards under the edge of the bottom cutter, by means of which short cuts appear, which can be joined together to form gentle curves. The second embodiment according to FIGS. 5 and 6 operates with cutting in essentially the same manner.

In this connection it should be mentioned, however, that instead of an upward and downward moving cutter, the top cutter can be replaced by a rotating cutter, which cooperates with the bottom edge. However, it is difficult to shorten the cutting length, in the manner which has been described, in the case of a rotating cutter, and such a design is therefore best suited for installations which are to operate with straight cutting lines or slightly curved cutting lines Furthermore, it should be mentioned that the cutting arrangement can be completed with rotational cutters in those cases in which it is desired to provide the possibility of cutting down the center of the cloth The clipping members according to FIGS. 3–6 do not provide such a possibility, but, on the other hand, as will be shown, penetrating down into already prepared cuts regardless of where they are situated on the surface of the cloth is possible.

If the cutter is to be moved in from the edge of the cloth, this is carried out simply by pressing down the bottom cutter into the soft surface of the conveyor belt and bringing the cutter inwards into the cloth. If, on the other hand, it is desired to penetrate down into a previously made cut, certain difficulties can occur. Thus, during cutting, the cloth may have moved somewhat so that the cutting edges overlap with each other. Moreover, the cloth may have moved somewhat so that the programmed position does not agree with the cutter. The cutting member must therefore have a certain detection possibility so as to be able to penetrate down into each cut made.

In the embodiment according to FIGS. 3 and 4 this is carried out by means of the cutting member being moved downwards with the bottom leg 72 parallel to the cut made or, at any rate, not at right angles to the latter. Thereafter, the arrangement is turned so that, during the pressing down which is then effected in the soft surface of the conveyor belt, the cutter moves in under the edge which its flattened front end 75 meets under the condition that it does not lie under the edge which the end of the cutter is moving from. However, the cutter is programmed to execute a forward and backward movement so as to then assume a final position transverse to the edge where the cut is to be made with the front end 75 directed in under that part to which this edge belongs. By means of the simultaneous clamping down and the pivoting detection movement, the bottom leg 72 of the cutter 70 can be placed under that cloth part which is to be cut, even if the cutting member has been moved downwards slightly at the side of the already made cut or the edges are overlapping.

In the embodiment according to FIGS. 5 and 6 the bottom leg 79 is fed downwards at an angle to the cut which is to be penetrated into. Thereafter, the cutting member is moved in a movement parallel to the direction of the bottom leg 79 in a movement from the cloth part in which the cut is to be made. In this connection the tooth 80 or similar is caught on the edge of the cloth part where the cut is not to be made and moves this away, so that the front part of the leg 79 can penetrate in under the edge to the part where the cut is to be made. This applies if this edge lies under the opposite edge. However, if the edge of the part in which the cut is to be made lies above the second edge or free of the latter, the leg 79 is fed in under this edge since the tooth does not then need to grip around the opposite edge and move below this cloth.

In summary, the cutting member according to FIGS. 3 and 4 performs a pivoting movement upon feeding in under the cloth part which is to be cut, while the cutting member according to FIGS. 5 and 6 performs a forward and backward movement in the direction of this bottom leg.

As has been mentioned, the automatic cutter units are controlled by the program fed into the computer. This includes information on which material roll is to be fed forwards if an automatic roller assembly is available and, moreover, information on cutting-out of the garment sections in accordance with the contours established in the pattern production and in positions which result in a considerable utilization of the surface of the material. Moreover, the program includes information on the relation of various garment sections to a particular set, and also the position which the garment sections will have in the carriers in the transport arrangement.

As the cutting progresses, the material web 18 is fed forwards by movement of the conveyor belt 19 and reaches the working area of the automatic picker for the two arrangements 41. The computer program now controls the two arrangements 41 so that, with their picking members 45, they pick up the cut-out garment sections from the working surface 17 and, in accordance with the identification which they have in the computer program, they place them over the respective plate 47 in the storage modules 42. This picking-up can be arranged to take place during intermittent or continuous movement of the material web. The position of the various modules and their plates 47 is also programmed into the computer program so that the automatic picker can be controlled by the said positioning data, data on the relationship of the sections and their allocation with respect to the individual plates in the storage modules 42, and also how the individual sections are to be laid with respect to turning and changing.

Furthermore, there is joint programming of the predetermined machining of the sets and allocation of each carrier for implementing this machining in the work stations.

Thus, when the section has been picked up from the working surface 17, the picking member moves upwards and, in accordance with the said programming, transfers the garment section to the intended plate in the predetermined module 42. When the program has indicated that all the garment sections which are to be taken up in the module have been transferred the garment sections are transferred for transport to the intended work stage.

It is also possible, within the scope of the invention, for the picking arrangements to be designed so as to transfer the garment sections directly to a carrier transported through the sewing installation without any intermediate storage. In this case it is expedient for the carrier to be designed as a clamp.

When all the garment sections have been picked up, only a number of strips of the material web remain, the wastage. As the material web is fed forwards, this wastage is dealt with by the device 49.

The cutting arrangement can be designed to not only cut out the garment sections along their contours but also to pre-treat the wastage, so that it is divided up when it leaves the conveyor belt.

If the machining of a certain material web is to be interrupted, the cutting arrangement is programmed to cut away that part which has already been processed, after which it continues on the conveyor belt towards the automatic picker. If the arrangement is designed for automatic roll feeding, the material of the remaining material web is thereafter rolled in, and the roll is changed with the aid of the forks 35 or any corresponding mechanism.

As has been mentioned, the preceding description constitutes only one example of the application of the invention in a clothes sewing installation. By means of suitable adjustment, it can also find application in another form of production.

Furthermore, the design of the arrangements described can also be adapted within the scope of the subsequent patent claims.

As the material web is fed forwards, this wastage is blown off by means of the arrangement 49. This is achieved by means of air being blown in through the nozzle 95. By the ejector effect, this air stream draws with it air in through the openings 96, and a strong air stream is obtained through the whole box and out through the connection piece 98. At the same time the brush cylinder 97 moves by means of the forward feed of the conveyor belt and gathers up the wastage from the rough, gripping surface of the conveyor belt and facilitates blowing off.

It is not necessary for the installation to have a composition such as has been mentioned, but certain parts described can be designed in another way or can be left out.

We claim:

1. An apparatus for cutting portions from a longitudinally extending web comprising:

a longitudinally extending support surface having at least a portion thereof made of a resiliently compressible composition, and including a first end and a second end remote from said first end, said web disposed in a predetermined plane on said support surface during cutting of said web;

means for moving said support surface in at least said longitudinally extending direction; and cutting means for selectively cutting said web at predetermined locations therealong, said cutting means comprising an upper member and a lower member cooperatively associated with said upper member for cutting said web therebetween, said lower member being postionable between said web and said support surface, whereby said lower member is moveable towards said support surface to engage and forcibly depress the resiliently compressible composition of said support surface to enable the web to remain in the predetermined plane during cutting of said web.

2. An apparatus as claimed in claim 1 wherein, said support surface comprises a relatively thin upper portion and a thicker lower portion, said lower portion comprising said resiliently compressible composition and being an air premeable elastomer foam material and said upper portion comprising a substantially incompressible material having a rough texture.

3. An apparatus as claimed in claim 1 wherein, said lower member comprises a vertical portion and a horizontal portion fixedly mounted to said vertical portion, said horizontal portion disposable beneath said web and including, an upper cutting edge and a substantially flat lower edge disposed to engage and forcibly depress into said support surface, said upper member comprising a lower cutting edge disposed for operative co-action with said upper cutting edge of said lower member during the cutting of said web, and slideable connecting means for slideably connecting said upper member to said vertical portion of said lower member.

4. An apparatus as claimed in claim 3 wherein, said cutting means includes at least one tooth fixedly connected to said substantially flat lower edge of said horizontal portion of said lower member, said at least one tooth extending substantially perpendicular to said substantially flat lower edge for clinging to an edge of said web.

5. An apparatus as claimed in claim 1 wherein, said cutting means includes carriage means for adjustable and selective movement of said upper and lower members along said support surface, said carriage means positioned above said predetermined plane of said support surface, and slideable means for sliding said upper and lower members along said carriage means.

6. An apparatus as claimed in claim 1 including, collecting means for collecting the portions cut from said web during the cutting operation.

7. An apparatus as claimed in claim 6 wherein said collecting means comprises, movement means for selective longitudinal movement along said support surface, pick-up means connected to said movement means for picking up said portions cut from said web, sliding means for transversely sliding said pick-up means along said movement means, and a storage module disposed above said predetermined plane of said support surface.

8. An apparatus as claimed in claim 7 wherein, said pick-up means comprises, jaw means for grabbing said portions cut from said web guide arm means for providing a support path for jaw means, runner means moveably mounted on said guide arm means for providing selective vertical movability of said jaw means, and means for actuating said jaw means from a closed to an open position.

9. An apparatus as claimed in claim 8 wherein, said jaw means comprises, a lower member and an upper member operatively associated with said lower member for grabbing and releasing said portions cut from said web, said lower member being positionable between said web and said support surface, whereby said lower member is depressable into said support surface so that said portions cut from said web remain in said predetermined plane prior to being grabbed by said upper and lower members.

10. An apparatus for cutting portions from a longitudinally extending web comprising:

a support surface having a first end and a second end spaced from said first end for supporting said web in a predetermined plane during cutting of said web, said support surface having, a relatively thin upper portion of a substantially incompressible material having a rough surface, and a thicker lower portion of a generally resiliently compressible air permeable composition in which depressions can be formed;

cutting means moveably positioned above said support surface for selectively cutting said web at predetermined locations therealong, said cutting means comprising, an upper member and a lower member operatively associated with said upper member for cutting said web therebetween, said lower member being positionable between said web and said support surface, whereby said lower member may be depressed into said support surface so that said web can remain in said predetermined plane during said cutting of said web, said lower member having a vertical portion and a horizontal portion fixedly mounted to said vertical portion, said horizontal portion being disposable beneath said web and including an upper cutting edge and a substantially flat lower edge disposed to engage and forcibly depress into said support surface, said upper member comprising a lower cutting edge disposed for operative co-action with said upper cutting edge of said lower member during cutting operations of said web; and collecting means operatively connected to said support surface for removing the portions cut from the web during the cutting operations, said collecting means comprising, movement means for selective movement along said support surface, sliding means arranged on said movement means for selective movement along said movement means, pick-up means arranged on said sliding means for picking up said portions cut from said web, and a storage module disposed above said predetermined plane of said support surface.

11. An apparatus as claimed in claim 10 wherein, said pick-up means comprises, jaw means for grabbing said portions cut from said web guide arm means for providing a support path for said jaw means, runner means moveably mounted on said guide arm means providing selective vertical mobility of said jaw means, and means for actuating said jaw means from a closed to an open position.

12. An apparatus as claimed in claim 11 wherein, said jaw means comprises, a lower member and an upper member operatively associated with said lower member for grabbing and releasing said portions cut from said web, said lower member being positionable between said web and said support surface, whereby said lower member being forcibly depressable into said support surface so that said portions cut from said web remain in said predetermined plane prior to being grabbed by said upper and lower members. positionable between said web and said support surface, whereby said lower member may be depressed into said support surface so that said web can remain in said predetermined plane during said cutting of said web, said lower member having a vertical portion and a horizontal portion fixedly mounted to said vertical portion, said horizontal portion being disposable beneath said web and including an upper cutting edge and a substantially flat lower edge disposed to engage and forcibly depress into said support surface, said upper member comprising a lower cutting edge disposed for operative co-action with said upper cutting edge of said lower member during cutting operations of said web; and collecting means operatively connected to said support surface for removing the portions cut from the web during the cutting operations, said collecting means comprising, movement means for selective movement along said support surface, sliding means arranged on said movement means for selective movement along said movement means, pick-up means arranged on said sliding means for picking up said portions cut from said web, and a storage module disposed above said predetermined plane of said support surface.

13. An apparatus as claimed in claim 10 wherein, said cutting means includes carriage means for adjustable and selective movement of said upper and lower members along said support surface, said carriage means positioned above said predetermined plane of said support surface, and slideable means for sliding said upper and lower members along said carriage means.

* * * * *

UNITED STATES PATENT AND TRADEMARK OFFICE

CERTIFICATE OF CORRECTION

PATENT NO. : 5,189,934

DATED : March 2, 1993

INVENTOR(S) : Davidson et al

It is certified that error appears in the above-indentified patent and that said Letters Patent is hereby corrected as shown below:

On the title page, Item [57]:

In the Abstract, line 5, between "the" and "cutting", insert --deposit surface by means of a slide arrangement (26). A--.

Column 2, line 25, after "layers", insert --.--.
Column 2, line 31, after "out", insert --.--.
Column 2, line 57, after "stations", insert --.--.
Column 3, line 58, after "surface", insert --.--.
Column 4, line 17, after "drawings", insert --.--.
Column 4, line 19, after "included", insert --.--.
Column 4, line 42, after "together", insert --.--.
Column 4, line 52, "h=" should read --be--.
Column 5, line 17, "h=" should read --be--.
Column 8, line 50, after "described", insert --.--.
Column 9, line 18, after "30", insert --.--.
Column 9, line 25, after "78", insert --.--.
Column 10, line 12, after "shown", insert --.--.
Column 10, line 15, after "carriage", insert --,--.
Column 10, line 41, "compress-ed" should read --compressed--.
Column 15, line 43, "premeable" should read --permeable--.
Column 16, line 17, after "web", insert --,--.

UNITED STATES PATENT AND TRADEMARK OFFICE

CERTIFICATE OF CORRECTION

PATENT NO. : 5,189,934

DATED : March 2, 1993

INVENTOR(S) : Davidson et al

It is certified that error appears in the above-indentified patent and that said Letters Patent is hereby corrected as shown below:

Column 17, line 25, delete beginning with "positionable between said" through Column 18, line 20.

Signed and Sealed this

Eighth Day of February, 1994

Bruce Lehman

*Attest:*

BRUCE LEHMAN

*Attesting Officer*

*Commissioner of Patents and Trademarks*